US008845824B2

(12) United States Patent
Lee

(10) Patent No.: US 8,845,824 B2
(45) Date of Patent: Sep. 30, 2014

(54) AUSTENITIC HEAT-RESISTING CAST STEEL AND EXHAUST MANIFOLD USING THE SAME

(75) Inventor: Jung Suk Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 218 days.

(21) Appl. No.: 13/323,418

(22) Filed: Dec. 12, 2011

(65) Prior Publication Data

US 2013/0025270 A1 Jan. 31, 2013

(30) Foreign Application Priority Data

Jul. 25, 2011 (KR) ..... 10-2011-0073590

(51) Int. Cl.

| | |
|---|---|
| ***C22C 38/42*** | (2006.01) |
| ***C22C 38/44*** | (2006.01) |
| ***C22C 38/48*** | (2006.01) |
| ***C22C 38/58*** | (2006.01) |
| ***F01N 13/10*** | (2010.01) |
| ***C22C 38/02*** | (2006.01) |
| ***C22C 38/00*** | (2006.01) |
| *F01N 13/16* | (2010.01) |

(52) U.S. Cl.

CPC ..... *C22C 38/58* (2013.01); *F01N 13/10* (2013.01); *F01N 13/16* (2013.01); *C22C 38/02* (2013.01); *F01N 2530/04* (2013.01); *C22C 38/001* (2013.01); *C22C 38/48* (2013.01); *C22C 38/44* (2013.01)

USPC ..... 148/325; 420/61; 420/65; 420/66

(58) Field of Classification Search

USPC ..... 148/325; 420/65, 66, 61

See application file for complete search history.

(56) References Cited

U.S. PATENT DOCUMENTS 3,969,109 A * 7/1976 Tanczyn ..... 420/40
5,571,343 A 11/1996 Ryoo et al.

FOREIGN PATENT DOCUMENTS

| | | | |
|---|---|---|---|
| JP | 08-049512 | A | 2/1996 |
| JP | 2000-204946 | A | 7/2000 |
| JP | 2002-309935 | A | 10/2002 |
| JP | 2006-315080 | A | 11/2006 |
| KR | 10-0424284 | B1 | 3/2004 |
| KR | 20110057835 | A | 6/2011 |
| WO | 2010/029012 | A1 | 3/2010 |

* cited by examiner

*Primary Examiner* — Deborah Yee

(74) *Attorney, Agent, or Firm* — Edwards Wildman Palmer LLP; Peter F. Corless

(57) ABSTRACT

An austenitic heat-resisting cast steel is disclosed which is composed mainly of Fe and including 0.4~0.6 wt % of C, 0.5~1.0 wt % of Si, 2.1~2.9 wt % of Mn, 2.1~2.9 wt % of Ni, 18~22 wt % of Cr, 1.0~2.0 wt % of Nb, 2.0~3.0 wt % of W, 0.25~0.35 wt % of N and other inevitable impurities. More specifically, this austenitic heat-resisting cast steel can beneficially be applied to an exhaust manifold of an automobile to realize a maximum allowable exhaust gas temperature of the exhaust manifold is 950° C.~1050° C.

5 Claims, 1 Drawing Sheet

AUSTENITIC HEAT-RESISTING CAST STEEL AND EXHAUST MANIFOLD USING THE SAME

CROSS-REFERENCE TO RELATED APPLICATION

This application claims under 35 U.S.C. §119(a) the benefit of Korean Patent Application No. 10-2011-0073590 filed on Jul. 25, 2011 the entire contents of which are incorporated herein by reference.

BACKGROUND OF THE INVENTION

1. Field of the Invention

The present invention relates to an austenitic heat-resisting cast steel having superior low-cycle fatigue life and creep resistance at high temperature and to an exhaust manifold using the same.

2. Description of the Related Art

An exhaust manifold of an automobile is an exhaust pipe that collects and creates an outlet channel for exhaust gas discharged from different cylinders into a single flow channel. An exhaust manifold is subjected to very high thermal impact depending on the output power of an engine because it is located at a position when the exhaust gas discharged from a head is first received from the engine. Since an exhaust manifold does not have a cooling mechanism, such as cooling water like the engine does, the temperature of the exhaust manifold increases to about 800° C.~900° C. upon engine acceleration, and rapidly lowers to the ambient air temperature when the engine is turned off. This procedure is repeated a few times per day and thus the thermal impact on the exhaust manifold is very severe due to the temperature irregularity which it is subjected to. Hence, the exhaust manifold must have very high durability.

The material that is currently available for the exhaust manifolds includes a high-temperature oxidation resistant cast iron material, for example, FCD-HS cast iron, SiMo cast iron and high-Ni austenitic cast steel containing a large amount of Ni. As such, the FCD-HS cast iron and the SiMo cast iron are being used by adding Si or Mo to a conventional spheroidal graphite cast iron material to improve high-temperature properties and oxidation resistance. The typical temperature range of an exhaust system using such heat-resisting cast iron is about 630~760° C., in which the temperature of exhaust gas is about 700~800° C. In this temperature range, the above materials have a fatigue life of about 200 cycles or less and a creep life of about 200 hours or less. In addition, although a high-Ni austenitic cast steel that has superior high-temperature properties compared to cast iron materials is being used, the commercial application thereof is limited by the price because expensive Ni is added in an amount of 10 wt % or more.

Furthermore, in accordance with increasing the output power requirements of automobiles and the strict controls of exhaust emission standards these days, the temperature of exhaust gas is continuously increased, and durability and quality are strictly controlled and thus the load which is applied to the exhaust system is increasing more and more each year. Hence, in the case of the exhaust manifold, a material with improved fatigue life and creep resistance in a higher temperature range is required. However, because of limitation of the addition of a large amount of Ni resulting in high manufacturing costs, there is a need to improve fatigue life and creep resistance necessary at high temperature while adding a minimum amount of Ni.

This related art is merely utilized to enhance understanding about the background of the present invention, and will not be regarded as conventional techniques known to those having ordinary knowledge in the art.

SUMMARY OF THE INVENTION

Accordingly, the present invention has been made keeping in mind the above problems encountered in the related art, and an object of the present invention is to provide an austenitic heat-resisting cast steel which has improved fatigue life and creep resistance at high temperature with the minimal addition of Ni, and also provides an exhaust manifold using the same.

In order to accomplish the above object, the present invention provides an austenitic heat-resisting cast steel composed mainly of Fe and comprising 0.4~0.6 wt % of C, 0.5~1.0 wt % of Si, 2.1~2.9 wt % of Mn, 2.1~2.9 wt % of Ni, 18~22 wt % of Cr, 1.0~2.0 wt % of Nb, 2.0~3.0 wt % of W, 0.25~0.35 wt % of N and other inevitable impurities. In the austenitic heat-resisting cast steel, a ratio of a Cr equivalent relative to a Ni equivalent (Cr equivalent/Ni equivalent) may be 0.8~0.9. The austenitic heat-resisting cast steel may have a structure comprising a matrix composed exclusively of austenite and a fine carbide formed therein. Furthermore, A maximum allowable surface temperature of a product manufactured from the austenitic heat-resisting cast steel may be 800° C.~900° C.

In addition, the present invention provides an exhaust manifold using the austenitic heat-resisting cast steel composed mainly of Fe and comprising 0.4~0.6 wt % of C, 0.5~1.0 wt % of Si, 2.1~2.9 wt % of Mn, 2.1~2.9 wt % of Ni, 18~22 wt % of Cr, 1.0~2.0 wt % of Nb, 2.0~3.0 wt % of W, 0.25~0.35 wt % of N and other inevitable impurities. Accordingly, in the illustrative embodiment of the present invention the maximum allowable exhaust gas temperature of the exhaust manifold may be 950° C.~1050° C.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF SPECIFIC EMBODIMENTS

Figure 1:
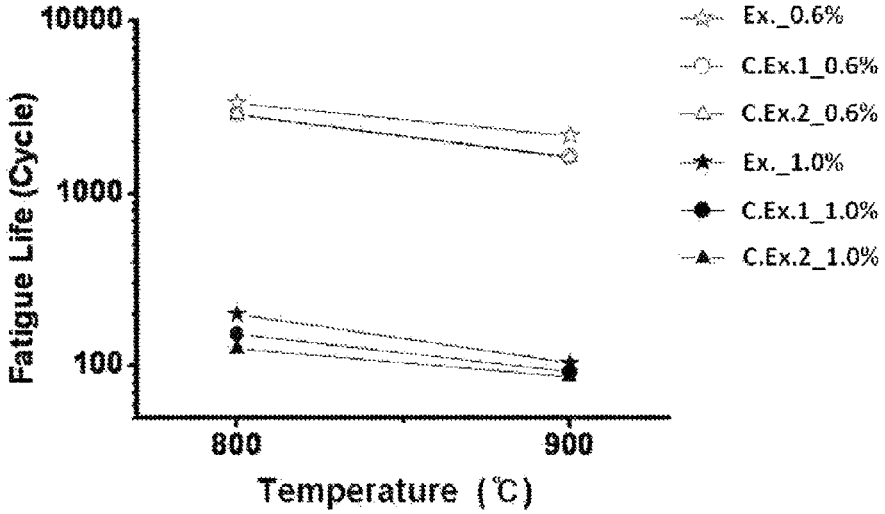
FIG. 1 is a graph showing results of conducting low-cycle fatigue tests on an austenitic heat-resisting cast steel according to an exemplary embodiment of the present invention.

Hereinafter, an austenitic heat-resisting cast steel and an exhaust manifold using the same according to preferred embodiments of the present invention will be described with reference to the accompanying drawings.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

According to the present invention, the austenitic heat-resisting cast steel is composed mainly of Fe and comprises 0.4~0.6 wt % of C, 0.5~1.0 wt % of Si, 2.1~2.9 wt % of Mn, 2.1~2.9 wt % of Ni, 18~22 wt % of Cr, 1.0~2.0 wt % of Nb, 2.0~3.0 wt % of W, 0.25~0.35 wt % of N and other inevitable impurities. Herein, the ratio of a Cr equivalent relative to a Ni equivalent (Cr equivalent/Ni equivalent) may fall in the range of 0.8~0.9. Also the austenitic heat-resisting cast steel may have a structure comprising a matrix composed exclusively of austenite and a fine carbide formed therein. The maximum allowable surface temperature of a product manufactured from the austenitic heat-resisting cast steel may be 800° C.~900° C.

In addition, the exhaust manifold manufactured using the above austenitic heat-resisting cast steel may include a material composed mainly of Fe and comprising 0.4~0.6 wt % of C, 0.5~1.0 wt % of Si, 2.1~2.9 wt % of Mn, 2.1~2.9 wt % of Ni, 18~22 wt % of Cr, 1.0~2.0 wt % of Nb, 2.0~3.0 wt % of W, 0.25~0.35 wt % of N and other inevitable impurities. The maximum allowable exhaust gas temperature of the exhaust manifold may be 950° C.~1050° C.

Specifically, the heat-resisting cast steel according to the present invention comprises Fe and additionally 0.4~0.6 wt % of C, 0.5~1.0 wt % of Si, 2.1~2.9 wt % of Mn, 2.1~2.9 wt % of Ni, 18~22 wt % of Cr, 1.0~2.0 wt % of Nb, 2.0~3.0 wt % of W, and 0.25~0.35 wt % of N. The austenitic heat-resisting cast steel according to the present invention is superior in terms of high-temperature fatigue life and elongation, and is thus very suitable for use in an exhaust manifold of an exhaust system.

More specifically, the austenitic heat-resisting cast steel according to the present invention includes Cr, Ni, Mn, Si, Nb, W and N to improve high-temperature properties, among other chemical components. When the matrix is composed of austenite, it is superior in high-temperature fatigue strength and is very advantageous at high temperature, compared to a ferrite matrix. Furthermore, the production of pearlite during heating and cooling is suppressed, thus preventing expansion due to phase transformation.

Also in the matrix composed exclusively of austenite without ferrite, the Ni equivalent should be increased and the Cr equivalent should be decreased in order to further increase high-temperature stability of austenite. Ni having a face centered cubic crystal structure stabilizes austenite having a face centered cubic structure, and C, N, and Mn may exhibit functions similar to those of Ni. Whereas, Cr having a body centered cubic crystal structure stabilizes ferrite having a body centered cubic structure, and Si, Nb, W, and Mo may exhibit functions similar to those of Cr. Thus, the composition of such cast steel is designed such that the ratio of the Cr equivalent relative to the Ni equivalent is minimized by increasing the amounts of elements that increase the Ni equivalent, without increasing the amounts of elements that increase the Cr equivalent.

The composition of the austenitic heat-resisting cast steel according to the present invention is quite different from that of a conventional material, and comprises a main component and is composed additionally of 0.4~0.6 wt % of C, 0.5~1.0 wt % of Si, 2.1~2.9 wt % of Mn, 2.1~2.9 wt % of Ni, 18~22 wt % of Cr, 1.0~2.0 wt % of Nb, 2.0~3.0 wt % of W and 0.25~0.35 wt % of N. Here, C increases melt fluidity, namely castability, and produces eutectic carbide with Nb, thus increasing castability. In order to effectively exhibit such effects, the amount of C is set to 0.4~0.6 wt %. If the amount thereof is less than 0.4 wt %, the desired effects are insignificant. In contrast, if the amount thereof exceeds 0.6 wt %, the effects are saturated and the excessive amount becomes unnecessary.

Si is an important element in the present invention, and the amount of thereof is 0.5~1.0 wt %. Si has an influence on an improvement in high-temperature fatigue strength in the austenitic cast steel. If the amount thereof is less than 0.5 wt %, melt fluidity may decrease upon casting, negatively affecting the castability. In contrast, if the amount thereof exceeds 1.0 wt %, a poor phase after casting may be formed thus causing brittleness.

Ni is typically added to improve high-temperature properties of heat-resisting cast steel and greatly affects improvements in fatigue life, creep resistance and ductility at high temperature. However, Ni is very expensive, thus frequently causing problems in which the resulting consumer price of Ni-added materials may vary depending on the price of Ni based on the increased prices of raw materials these days. Hence, it is essential to develop a material able to exhibit the same properties while minimizing the addition of Ni. Thus, in the present invention, the amount of Ni is limited to 2.1~2.9 wt % so as not to exceed 2.9 wt %. This amount is the minimum that is necessary to improve the high-temperature properties of austenitic heat-resisting cast steel, and the other properties including heat resistance and corrosion resistance are supplemented for by the addition of relatively inexpensive N and Cr.

Cr contributes to oxidation resistance and functions to complement the functions of Ni which is added in a relatively small amount in the present invention, thus improving fatigue life and properties similar to Ni. The price of Cr is about 10~30% of the price of Ni, thus enabling an exhaust manifold whose fabrication is very profitable. In the present invention Cr is added in an amount of 18~22 wt %. If the amount of Cr is less than 18 wt %, insignificant effects may be obtained. In contrast, if the amount thereof exceeds 22 wt %, the matrix may include not austenite but ferrite.

Nb, which is added in an amount of 1.0~2.0 wt %, is bound with C to form a fine carbide so as to increase high-temperature fatigue life. W which is added in an amount of 2.0~3.0 wt % is bound with C, like Nb, so that a fine carbide is formed to increase the high-temperature fatigue life.

N is an important element that stabilizes austenite to thus improve the fatigue life and creep resistance at high temperature, like Ni, and the price thereof is less than about 5% of that of Ni, thus enabling an exhaust manifold whose fabrication is very profitable. If the amount of N is less than 0.25 wt %, the resulting effects cannot be substituted for the high-temperature properties of Ni. In contrast, if N is excessively added, brittleness may occur due to precipitation of a nitride with Cr. Thus, the amount of N is set to 0.35 wt %.

When the amount of added Mn is increased, a dispersoid may be formed in the structure during solidification without additional thermal treatment, thus increasing the fatigue life and also increasing solid solubility in the matrix of N. If the amount of Mn is less than 2.1 wt %, the solid solubility of N may decrease, undesirably deteriorating the high-temperature stability. In contrast, if Mn is excessively added, ductility and corrosion resistance may decrease. Hence, the amount of Mn is set to 2.1~2.9 wt %. Thereby, the ratio of the Cr equivalent relative to the Ni equivalent (Cr equivalent/Ni equivalent) is 0.80~0.90, so that austenite is stabilized.

The present material may have a maximum allowable surface temperature of 800° C.~900° C., and may be applied to a maximum exhaust gas temperature of 950° C.~1050° C. Thus, an austenitic heat-resisting cast steel product according to the present invention may be appropriate for use in the exhaust manifold of a high output power engine.

Table 1 below shows the compositions of heat-resisting cast steel of the example and the comparative examples.

TABLE 1

| | Chemical Component (wt %) | | | | | | | | Cr Equiv./ |
|---|---|---|---|---|---|---|---|---|---|
| | C | Si | Mn | Ni | Cr | Nb | W | N | Ni Equiv. |
| Ex. | 0.53 | 0.81 | 3.98 | 3.45 | 20.2 | 1.56 | 2.46 | 0.30 | 0.83 |
| C. Ex. 1 | 0.34 | 1.11 | 1.04 | 11.3 | 21.4 | 1.53 | 2.79 | — | 1.17 |
| C. Ex. 2 | 0.4 | 1.13 | 1.03 | 13.2 | 24.5 | 1.74 | — | — | 1.05 |

Here, the Ni equivalent is calculated by Ni+30(C+N)+0.5Mn, and the Cr equivalent is calculated by Cr+1.5Si+0.5Nb+0.72W. The above example is the austenitic heat-resisting cast steel product according to the present invention, and Comparative Examples 1 and 2 are conventional heat-resisting cast steel products.

Figure 2:
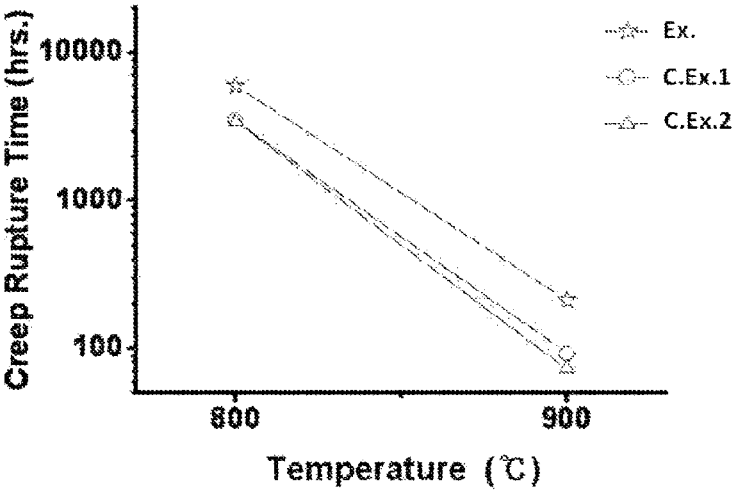
FIG. 2 is a graph showing creep test results of the austenitic heat-resisting cast steel according to the exemplary embodiment of the present invention.

On the other hand, the test results for the above example and comparative examples are shown in FIGS. 1 and 2. FIG. 1 is a graph showing the results of low-cycle fatigue tests done on the austenitic heat-resisting cast steel according to an embodiment of the present invention, and FIG. 2 is a graph showing the creep test results of the austenitic heat-resisting cast steel product according to the embodiment of the present invention. Specifically, a high-temperature low-cycle fatigue test was performed with a strain amplitude of 0.6% and 1.0% at 800° C. and 900° C. according to ASTM E606 'Standard Practice for Strain-Controlled Fatigue Testing'. Also, according to ASTM E139 'Standard Test Methods for Conducting Creep, Creep-Rupture, and Stress-Rupture Tests of Metallic Materials', a creep test was carried out at 800° C./60 MPa and 900° C./60 MPa, and creep rupture time was measured.

Table 2 below shows the above test results together with FIGS. 1 and 2.

TABLE 2

| | Creep Life (hr) | | Low-cycle Fatigue Life (cycle) | | | |
|---|---|---|---|---|---|---|
| | 800° C./ | 900° C./ | 800° C. | | 900° C. | |
| | 60 MPa | 60 MPa | 0.6% | 1.0% | 0.6% | 1.0% |
| Ex. | 5984 | 212 | 3356 | 201 | 2178 | 104 |
| C. Ex. 1 | 3516 | 92 | 2854 | 153 | 1643 | 92 |
| C. Ex. 2 | 3429 | 73 | 2873 | 125 | 1621 | 87 |

In the results of testing the high-temperature properties shown above, the example according to the present invention exhibited very superior high-temperature fatigue life and creep life at a material surface temperature of 800° C.~900° C. corresponding to a severe exhaust system mode. Also, creep life was higher in the example made according to the present invention than in the comparative examples. This is thought to be because Ni, Cr, Mn, W, Nb, and N contribute to improving the high-temperature fatigue life, and N greatly contributes to increasing the elongation.

As described hereinbefore, the present invention provides an austenitic heat-resisting cast steel and an exhaust manifold using the same. According to the present invention, even when a minimum amount of expensive Ni is used, it is possible to manufacture an exhaust manifold having an improved fatigue life and creep resistance at high temperatures. Thus, such an exhaust manifold can be reliably and inexpensively applied to engines having high-efficiency and a low rate of fuel consumption.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An austenitic heat-resisting cast steel, composed of Fe and comprising 0.4~0.6 wt % of C, 0.5~1.0 wt % of Si, 2.1~2.9 wt % of Mn, 2.1~2.9 wt % of Ni, 18~22 wt % of Cr, 1.0~2.0 wt % of Nb, 2.0~3.0 wt % of W, 0.25~0.35 wt % of N and other inevitable impurities, wherein a ratio of a Cr equivalent relative to a Ni equivalent (Cr equivalent/Ni equivalent) is 0.8~0.9.

2. The austenitic heat-resisting cast steel of claim 1, wherein the austenitic heat-resisting cast steel has a structure comprising a matrix composed exclusively of austenite and a fine carbide formed therein.

3. The austenitic heat-resisting cast steel of claim 1, wherein a maximum allowable surface temperature of a product manufactured from the austenitic heat-resisting cast steel is 800° C.~900° C.

4. An exhaust manifold, using an austenitic heat-resisting cast steel composed of Fe and comprising 0.4~0.6 wt % of C, 0.5~1.0 wt % of Si, 2.1~2.9 wt % of Mn, 2.1~2.9 wt % of Ni, 18~22 wt % of Cr, 1.0~2.0 wt % of Nb, 2.0~3.0 wt % of W, 0.25~0.35 wt % of N and other inevitable impurities, wherein a ratio of a Cr equivalent relative to a Ni equivalent (Cr equivalent/Ni equivalent) is 0.8~0.9.

5. The exhaust manifold of claim 4, wherein a maximum allowable exhaust gas temperature of the exhaust manifold is 950° C.~1050° C.

* * * * *